US011351511B2

(12) United States Patent
Hsu et al.

(10) Patent No.: US 11,351,511 B2
(45) Date of Patent: Jun. 7, 2022

(54) ROTARY BUCKET MIXING DEVICE AND ROTATING DISK ASSEMBLY

(71) Applicant: ASIA IC MIC-PROCESS, INC., Taipei (TW)

(72) Inventors: Hung-Hsin Hsu, Taipei (TW); Yan-Lan Chiou, Taipei (TW)

(73) Assignee: ASIA IC MIC-PROCESS, INC., Taipei (TW)

( * ) Notice: Subject to any disclaimer, the term of this patent is extended or adjusted under 35 U.S.C. 154(b) by 52 days.

(21) Appl. No.: 16/897,578

(22) Filed: Jun. 10, 2020

(65) Prior Publication Data

US 2020/0406204 A1 Dec. 31, 2020

(30) Foreign Application Priority Data

Jun. 28, 2019 (TW) ..... 108208484

(51) Int. Cl.
*B01F 29/31* (2022.01)
*B01F 29/34* (2022.01)
*B01F 29/00* (2022.01)

(52) U.S. Cl.
CPC ..... *B01F 29/31* (2022.01); *B01F 29/34* (2022.01); *B01F 29/4022* (2022.01)

(58) Field of Classification Search
CPC .. B01F 9/0016; B01F 9/003; B01F 2009/009; B01F 15/0074; B01F 9/0005; B01F 2009/0063; B01F 9/02; B01F 9/04; B01F 29/31; B01F 29/34; B01F 29/4022; B01F 35/421; B01F 29/20
USPC ..... 366/141, 208–217, 233, 605
See application file for complete search history.

(56) References Cited

U.S. PATENT DOCUMENTS 1,755,763 A * 4/1930 Barber ..... B08B 9/0817 134/150
2,367,585 A * 1/1945 Huszar ..... B02C 17/04 241/171
2,513,413 A * 7/1950 Huszar ..... B02C 17/18 241/171
2,630,301 A * 3/1953 Lentz ..... B01F 9/0034 366/233
4,123,176 A * 10/1978 Barker ..... B01F 15/00753 366/213
4,568,194 A * 2/1986 Gargioni ..... B44D 3/003 366/213
5,427,947 A * 6/1995 Dalos ..... C05F 17/50 435/290.3
5,624,185 A * 4/1997 Whisson ..... A61M 1/0245 366/141
7,604,392 B2 * 10/2009 Brezinsky ..... A47J 43/042 366/211
9,157,509 B2 * 10/2015 Lessard ..... F16H 1/22
(Continued)

*Primary Examiner* — Charles Cooley

(57) ABSTRACT

A rotary bucket mixing device is disclosed. The rotary bucket mixing device includes a main body, a rotating disk assembly, a power gear assembly and a first idler assembly. The power gear assembly receives a power to drive the rotating disk assembly to rotate and thereby rotating a mixing bucket disposed on a supporting assembly of the rotating disk assembly and mixing the contents in the mixing bucket. The first idler assembly controls a rotational speed. The rotary bucket mixing device of the present disclosure provides a better support to the mixing bucket and therefore the safety during the mixing process is enhanced.

16 Claims, 4 Drawing Sheets

(56) References Cited

U.S. PATENT DOCUMENTS

| | | | | |
|---|---|---|---|---|
| 10,272,402 | B2 * | 4/2019 | Tun | B01F 3/18 |
| 2004/0218466 | A1 * | 11/2004 | Midas | B01F 15/00733 366/208 |
| 2015/0036452 | A1 * | 2/2015 | Tun | B01F 9/02 366/143 |
| 2020/0406204 | A1 * | 12/2020 | Hsu | B01F 9/0016 |

* cited by examiner

ROTARY BUCKET MIXING DEVICE AND ROTATING DISK ASSEMBLY

REFERENCE TO RELATED APPLICATIONS

This non-provisional application claims priority claim under 35 U.S.C. § 119(a) on Taiwan Patent Application No. 108208484 filed Jun. 28, 2019 the entire contents of which are incorporated herein by reference.

TECHNICAL FIELD

The present disclosure relates to a rotary bucket mixing device and a rotating disk assembly, more particularly, to a rotary bucket mixing device and a rotating disk assembly that are capable of holding a mixing bucket stably on the rotating disk assembly with enhanced support to the mixing bucket.

BACKGROUND

In semiconductor process, optoelectronic process, pharmaceutical process, chemical process, food process, or other processes, mixing devices are often required to prepare the product or to aid the production. A conventional mixing device uses a dual-axis bucket holder and clamps to hold a mixing bucket, wherein the dual-axis bucket holder is parallel or perpendicular to a ground.

For example, there was a mixing device with dual-axis holder parallel to the ground, wherein the dual-axis holder was perpendicular to a wall and was connected to the wall. There was also a mixing device with dual-axis holder perpendicular to the ground, wherein the dual-axis holder was perpendicular to and indirectly mounted on the ground. These two types of mixing devices use just two clamps, which are pivotally connected to the dual-axis holder, to hold the mixing bucket, and by which the mixing bucket is indirectly supported by the dual-axis holder.

During the mixing process, the two clamps are turned to make the mixing bucket rotate so as to mix the contents in the mixing bucket, and the usage of the two clamps are the same for both of the two aforementioned mixing devices. The weight of the mixing bucket is only supported at two supporting points, which are the connecting points of the dual-axis holder to the wall or the ground, and thus the loading on the dual-axis holder and the clamps is quite large and the provided support is unsatisfying. In addition, in the mixing process by either of the two mixing devices, the mixing bucket may spill or splash some contents therefrom because it was improperly mounted due to lack of support to the mixing bucket. The contents could be corrosive or high-temperature matters such as solids, liquid or gases, and the spilling or splashing thereof would be a safety concern to the workers. Moreover, the dual-axis holder and the clamps could break during the mixing process and thereby causing serious work accidents.

Some of the current mixing devices mix the contents in the mixing bucket by 360-degree rotation in a single direction, and other mixing devices mix the contents by swinging the mixing bucket one-way. The mixed contents produced by these two methods could encounter issues like uneven mixture or increased mixing time because there is relatively less action of the mixing bucket in the mixing process.

SUMMARY

Therefore, to overcome the deficiencies in the conventional technology, an object of the present disclosure is to provide a rotary bucket mixing device which has a rotating disk assembly. The rotating disk assembly includes a bucket support assembly for disposing a mixing bucket therein. The rotating disk assembly is turned and moved by a power gear of a power gear assembly to rotate the mixing bucket and mix the contents in the mixing bucket. Also, the rotary bucket mixing device includes a first idler assembly for controlling a rotational speed of the rotating disk assembly, which in turn adjusts a rotational speed of the mixing bucket during the mixing process. The present disclosure enhances the support to the mixing bucket by supporting the mixing bucket with the rotating disk assembly, and hence the issue of conventional mixing device having unsatisfactory support to mixing buckets is improved.

It is then an object of the present disclosure to provide a rotary bucket mixing device with a main body, a rotating disk assembly, a power gear assembly, and a first idler assembly. The rotating disk assembly is a circular body, which includes a plurality of first teeth formed on an outer ring periphery thereof and a hollow bucket support assembly formed therein for disposing a mixing bucket in a hollow portion of the circular body. The power gear assembly is connected to the main body and includes a power gear, and the power gear is in contact with and engaged or geared to a first portion of the first teeth and receives a power to rotate the rotating disk assembly. The first idler assembly is connected to the main body and includes a first idler. The first idler is in contact with and engaged or geared to a second portion of the first teeth for controlling a rotational speed of the rotating disk assembly.

Optionally, the rotary bucket mixing device further includes a power output device connected to the main body or the power gear assembly and pivotally connected to the power gear for generating the power to the power gear.

Optionally, the power output device is a rotor motor device or a manpowered rotating disk device.

Optionally, the rotary bucket mixing device further includes a second idler assembly connected to the main body. The second idler assembly includes a second idler that is in contact with and engaged or geared to a third portion of the first teeth for controlling a rotational speed of the rotating disk assembly.

Optionally, the bucket support assembly includes a circular bearing support assembly and a bucket mounting assembly. The circular bearing support assembly has a hollow center for the mixing bucket to be disposed therein, and the bucket mounting assembly is connected to the circular bearing support assembly for mounting the mixing bucket.

Optionally, the rotary bucket mixing device further includes at least one weighing module disposed on at least one of the bucket support assembly, the first idler assembly, and the second idler assembly, for monitoring weight changes of a plurality of contents in the mixing bucket.

Optionally, the main body further includes a tray holder disposed below the rotating disk assembly and the rotary bucket mixing device further includes a tray detachably disposed in the tray holder, for catching at least one content dropped from the mixing bucket.

Another object of the present disclosure is to provide a rotating disk assembly that is for use in a rotary bucket mixing device. The rotating disk assembly is a circular body and includes a plurality of first teeth formed on an outer ring periphery of the circular body and a hollow bucket support assembly formed therein for disposing a mixing bucket in a hollow portion of the circular body. The bucket support assembly includes a circular bearing support assembly and a bucket mounting assembly. The circular bearing support assembly is connected to the rotating disk assembly and has a hollow center for disposing the mixing bucket therein. The bucket mounting assembly is connected to the circular bearing support assembly for mounting the mixing bucket.

Optionally, the bucket mounting assembly includes a ring piece assembly and a clamp assembly. The ring piece assembly is connected to the circular bearing support assembly and includes an openable ring piece for encircling and mounting the mixing bucket. The clamp assembly is connected to the circular bearing support assembly and includes at least one movable clamp for clamping the mixing bucket.

Optionally, the bucket mounting assembly is pivotally connected to the rotating disk assembly.

Optionally, a tilt angle is formed between the mixing bucket and the rotating disk assembly, wherein the tilt angle is adjustable or controllable.

Optionally, the main body includes a roller set disposed at a bottom of the bucket mounting assembly for providing assistance in loading and unloading the mixing bucket onto and from the bucket mounting assembly.

In short, the present disclosure provides a rotary bucket mixing device with enhanced support to a mixing bucket, which resolves the loading issue occurring on the dual-axis holder of conventional mixing devices, and in turn prevents accidents caused by the mixing bucket dropping or flying off in the mixing process due to improper mounting of the mixing bucket. Worker's safety during the mixing process is thus enhanced and so the advantages is obvious to industries like semiconductor, optoelectronic, pharmaceutical, chemical, food process, or other industries that have a need for mixing devices.

BRIEF DESCRIPTION OF THE DRAWINGS

The structure as well as preferred modes of use, further objects, and advantages of this invention will be best understood by referring to the following detailed description of some illustrative embodiments in conjunction with the accompanying drawings, in which.

DETAILED DESCRIPTION OF THE PREFERRED EMBODIMENTS

The present disclosure provides a rotary bucket mixing device with a main body, a rotating disk assembly, a power gear assembly, and a first idler assembly. The power gear assembly receives a power to drive and rotate or turn the rotating disk assembly, and thereby rotating or turning a mixing bucket disposed on a bucket support assembly of the rotating disk assembly to achieve a good mixing result. The first idler assembly controls a rotational speed. The rotary bucket mixing device of the present disclosure provides better support to the mixing bucket and so the on-site safety during the mixing process is increased. Moreover, the rotary bucket mixing device as described herein is capable of tilting the mixing bucket and rotating the mixing bucket 360 degrees at the same time to ensure a complete mix of the contents, and thus the mixing result is enhanced.

Figure 1:
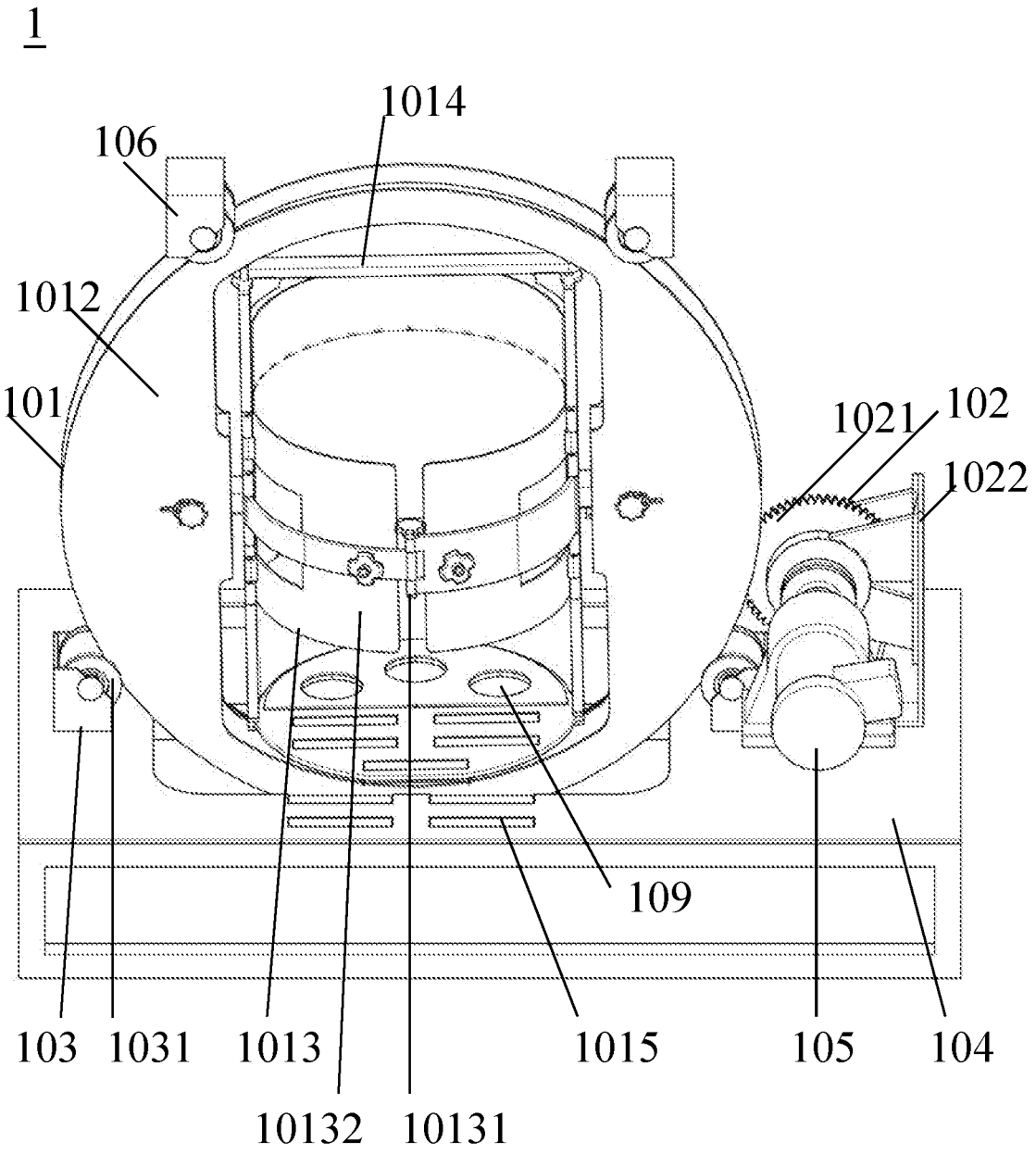
FIG. 1 is a schematic front view of a rotary bucket mixing device according to an embodiment of the present disclosure.
Figure 2:
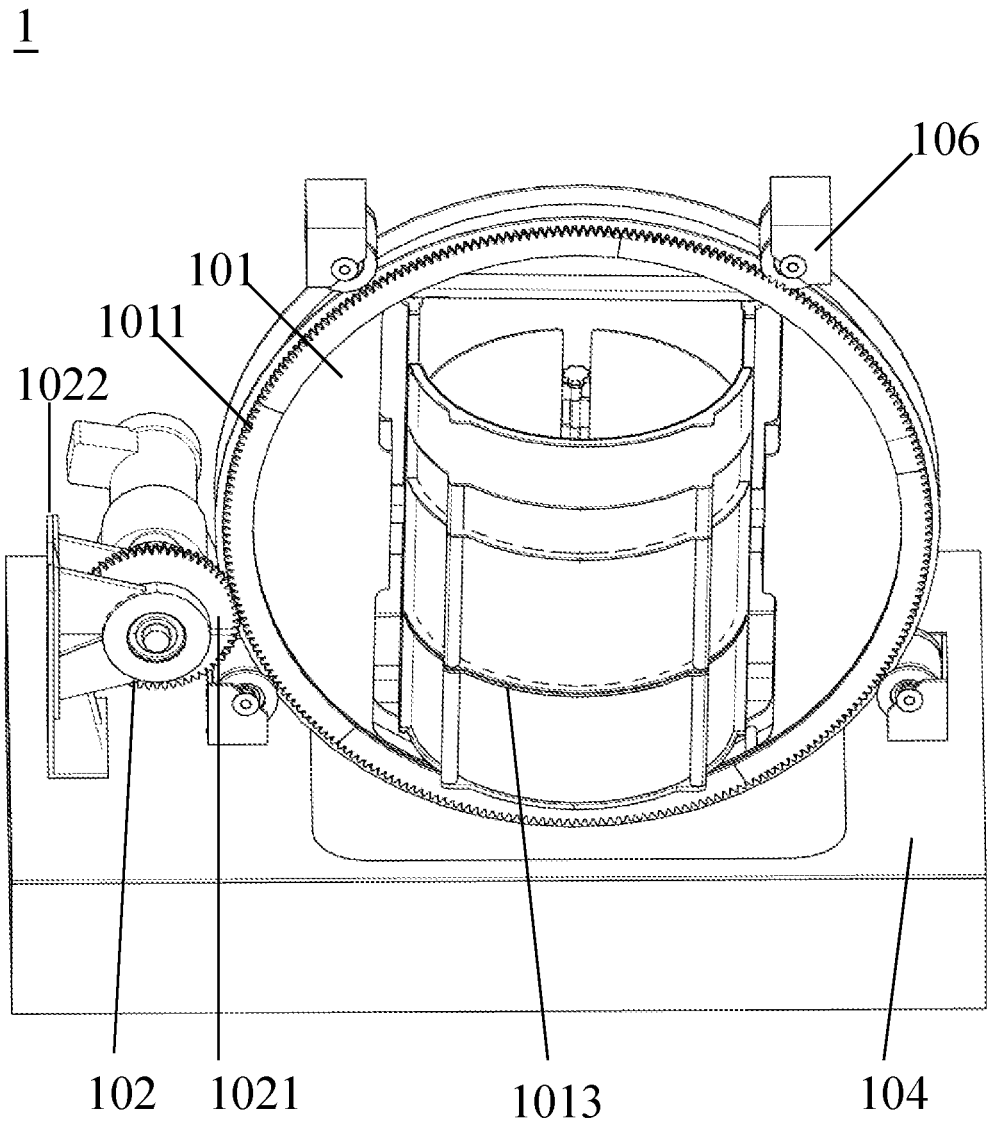
FIG. 2 is a schematic back view of a rotary bucket mixing device according to an embodiment of the present disclosure.

First, referring to FIGS. 1 and 2, which are respectively a front view and a back view of a rotary bucket mixing device according to an embodiment of the present disclosure, the rotary bucket mixing device 1 is basically composed of a rotating disk assembly 101, a power gear assembly 102, a first idler assembly 103, and a main body 104.

The rotating disk assembly 101 is a circular body, and a plurality of first teeth 1011 is formed on an outer ring periphery of the circular body. In this embodiment, the inner side of the circular body has a rectangular hollow portion and is formed as a bucket support assembly for disposing and mounting a mixing bucket to the rotating disk assembly 101. However, the present disclosure is not limited by the shape or appearance of the hollow portion.

The bucket support assembly includes a circular bearing support assembly 1012 and a bucket mounting assembly. The circular bearing support assembly is a double-layer disc holder, wherein the center thereof is hollowed out to provide a place for positioning the mixing bucket. The bucket mounting assembly includes a ring piece assembly 1013 and a clamp assembly 1014. The present disclosure does not limit the shape and appearance of the bucket support assembly and the bucket mounting assembly, and the bucket mounting assembly can also be straps or buckles or any devices that can be used to mount the mixing bucket. As well, the circular bearing support assembly 1012 can be a single-layer disc holder or a multilayer disc holder.

Through the ring piece assembly 1013 and the clamp assembly 1014 of the rotating disk assembly 101, the mixing bucket is secured and mounted in the rotary bucket mixing device 1. As shown in FIG. 1, the ring piece assembly 1013 holds the mixing barrel horizontally and is a double-layer ring formed by multiple sheets. The ring piece assembly 1013 has a space-expansion function, which can horizontally hold mixing buckets of different sizes. The ring piece assembly 1013 includes a lock device 10131 and a holding ring 10132, but the present disclosure is not limited thereby; the ring piece assembly 1013 could also be an integral piece, the present disclosure does not limit the number and layers of the ring piece assembly 1013. Further, the ring piece assembly 1013 can also be replaced by any other form of horizontal clamping assemblies; the present disclosure is not limited thereby.

The ring piece assembly 1013 encircles the outer side of the mixing bucket to hold the mixing bucket in a horizontal direction (not shown in FIGS. 1 and 2). When the mixing bucket is ready to be mounted on the rotary bucket mixing device 1, the holding ring 10132 is opened to put the mixing bucket in the ring piece assembly 1013. Then, when the mixing bucket is disposed at the correct position and place, the holding ring 10132 is closed at the front and is tightly fastened by the lock device 10131, and the mounting of the mixing bucket with the ring piece assembly 1013 is complete. In other words, the holding ring 10132 is an openable ring piece. Moreover, the holding ring 10132 at the back is designed to be unopenable. The front and back of the holding ring 10132 can be a ring made of one piece or multiple sheets, and the present disclosure is not limited thereby. The lock device 10131 in this embodiment is implemented by screws and corresponding holes, but the present disclosure is not limited thereby. When the ring piece assembly 1013 encircles and holds the mixing bucket, the center of gravity of the mixing bucket is stabilized in the mixing process.

The clamp assembly 1014 is a movable clamp at the top, and the clamp assembly 1014 clamps, presses, and holds the mixing bucket vertically via a transverse bar or a transverse board to achieve the hold effect. When the mixing bucket is ready to be disposed in the rotary bucket mixing device 1, the transverse board of the clamp assembly 1014 is adjusted to move upward so as to create enough space for the mixing bucket to be placed in the bucket mounting assembly. Then, when the mixing bucket is disposed at the correction position and place, the transverse board is adjusted downward until it is in close contact with the top of the mixing bucket, and so the mounting of the mixing bucket with the clamping assembly 1014 is complete.

It is to be noted that the present disclosure does not limit the clamp assembly 1014 as described above, and nor is the number, appearance and clamping direction of the clamp assembly 1014. For example, the clamp assembly 1014 may include two clamps, one is an upper bar and one is a lower bar, and both clamps are movable to push against the top and bottom of the mixing bucket, respectively. When the mixing bucket is clamped and held by the clamp assembly 1014, its' center of gravity is stabilized during mixing.

The ring piece assembly 1013 and the clamp assembly 1014 can both be adjusted according to the size of the mixing bucket, and the volume of the mixing bucket can be 5 to 50 gallons, but the present disclosure is not limited thereby.

Figure 3:
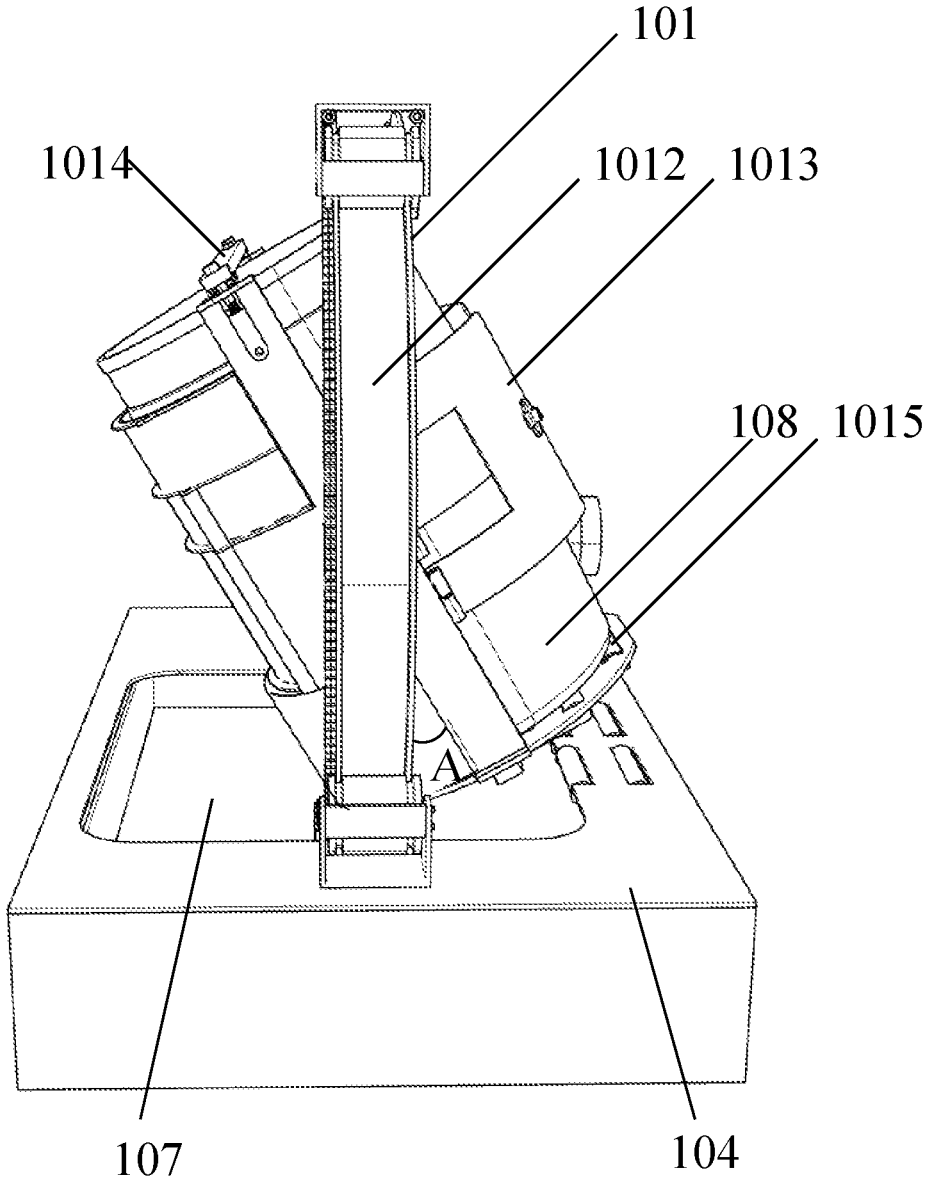
FIG. 3 is a schematic side view of a rotary bucket mixing device according to an embodiment of the present disclosure.

FIG. 3 is a schematic side view of a rotary bucket mixing device according to an embodiment of the present disclosure. As shown in FIG. 3, the ring piece assembly 1013 and the clamp assembly 1014 are pivotally connected to the rotating disk assembly 101. When the mixing bucket 108 is disposed on the circular bearing support assembly 1012 of the rotary bucket mixing device 1, there is a tilt angle A between the mixing bucket 108 and the rotating disk assembly 101. The tilt angle is adjustable and controllable, and it can be used to accommodate different mixing processes so the contents in the mixing bucket can be mixed continuously and completely without any dead angle, but the present disclosure does not limit the angle of the tile angle A. For example, the tilt angle A is within a range of plus 60 degrees to minus 60 degrees; the present disclosure is not limited thereby. When the tilt angle is 0, the mixing bucket 108 is perpendicular to the ground, and when the tilt angle is plus or minus 30 degrees, an angle between the mixing bucket 108 and the ground is respectively 60 degrees and 120 degrees.

Next, as shown in FIGS. 1 and 3, the rotary bucket mixing device 1 further includes a roller set 1015. The roller set 1015 is disposed at a bottom of the bucket mounting assembly and is used to assist the mixing bucket to slide and to be disposed on the bucket mounting assembly, or to assist the unloading of the mixing bucket from the bucket mounting assembly.

How the mixing bucket is mounted in the rotary bucket mixing device 1 has been described above and herein the mixing procedure and process will be described with reference to FIGS. 1 and 2. The power gear assembly 102 of the rotary bucket mixing device 1 includes a power gear 1021 and a gear seat 1022. The power gear 1021 includes a plurality of teeth and, at its center, a fix hole and a pivot hole. The power gear 1021 is engaged to or geared to the first teeth 1011 of the rotating disk assembly 101 via its plurality of teeth and is connected to the gear seat 1022 via the fix hole and therefore is secured to the main body 104.

The power gear 1021 is pivotally connected to a power output device via the pivot hole, and in this embodiment, the power output device is a rotor motor device 105, but the present disclosure is not limited thereby, the power output device can also be a manpowered rotating disk device. To start the mixing process, the power output device provides power to the power gear 1021, which then drives the rotating disk assembly 101 to rotate and makes the mixing bucket rotate to mix the contents therein.

Then, referring to FIGS. 1 and 2, the rotary bucket mixing device 1 includes at least one idler assembly 103, 106, and by the at least one idler assembly 103, 106, a rotational speed of the rotating disk assembly 101 is controlled in the mixing process. Hence, a mixing speed is adjusted or modulated. The rotary bucket mixing device 1 further includes a brake device to help the idler assembly 103, 106 modulate the mixing speed, but the present disclosure is not limited thereby. In this embodiment, the rotary bucket mixing device 1 includes four idler assemblies, wherein a first idler assembly 103 is disposed on the main body 104 and includes a first idler 1031 in contact with and geared to the first teeth 1011, and the first idler assembly 103 and the power gear assembly 102 are relatively positioned at the opposite sides of the rotating disk assembly 101. The opposing positions of the first idler assembly 103 and the power gear assembly 102 as shown is good for the rotating disk assembly's stability.

Moreover, the rotary bucket mixing device 1 further includes a second idler assembly 106 with a second idler in contact with and geared to the first teeth 1011, and a third idler assembly and a fourth idler assembly with similar configurations. These four idler assemblies are respectively positioned at four corners of the rotating disk assembly 101, which are upper left hand corner, upper right hand corner, lower left hand corner, and lower right hand corner. The present disclosure does not limit the number and position of the idler assembly.

When mixing the contents in the mixing bucket, the rotating disk assembly 101 rotates via the power gear assembly 102 and relies on at least one idler assembly 103, 106 to control the rotational speed. For example, the power gear 1021 of the power gear assembly 102 is geared to a first portion of the first teeth 1011, the first idler 1031 of the first idler assembly 103 is geared to a second portion of the first teeth 1011, and the second idler of the second idler assembly 106 is geared to a third portion of the first teeth 1011. As such, the power gear assembly 102 and the idler assembly can carry the weight of the mixing bucket and the rotating disk assembly 101 together and stabilize the center of gravity, and thus the loading put on the components of the rotary bucket mixing device 1 is reduced, which prolongs the lifecycle of the rotary bucket mixing device 1 and its' components.

Furthermore, the rotary bucket mixing device 1 also includes at least one weighing module (not shown) so as to timely monitor weight changes of a plurality of contents in the mixing bucket during the mixing process. There is no limitation on positions where the weighing module is to be disposed. It could be any place on the bucket support assembly, or on the idler assembly 103, 106. Preferably, the weighing module is disposed on the transverse board of the clamp assembly 1014, such that when the mixing bucket is turning and rotating, the weighing module can immediately measure the weight change of the contents in the mixing bucket. In addition, while the weighing module is weighing the contents in the mixing process, the best mixing frequency can be obtained by programmable computation at the same time, and the flow rate and flow change of the contents can also be measured as well as the spilling or splashing of the contents can be monitored for quality control. The present disclosure is not limited thereby and does not limit the number of or position of the weighing module.

Next, a weighing operation process by a weighing module is described in the following example. In this example, a rotary bucket mixing device includes two weighing modules 1016 and the weighing modules 1016 are respectively disposed on the top and the bottom of the clamp assembly 1014. With this arrangement, the weighing modules 1016 are positioned on the top and at the bottom of, or above and below, a mixing bucket. Before the mixing process begins, the bottom weighing module (not shown) measures and records the weight of the mixing bucket with a plurality of contents. Then, during the mixing process, the top and bottom weighing modules 1016 are rotated and each of which alternately reaches the lowest position, and thereby the two weighing modules 1016 can take turns measuring and recording the weight of the mixing bucket with the contents. Through the two weighing modules 1016, the constantly monitored weight can be used for quality control and management. If the weights measured by the two weighing modules 1016 have a significant difference, then the rotating parameters, such as the rotational speed, can be adjusted immediately to get the best mixing result. The feature of weight-monitoring is more suitable for liquid contents having solids or contents that are prone to deterioration or change.

Referring to FIG. 3, the main body 104 of the rotary bucket mixing device 1 is a hexahedron base with an opening formed at its top side to form a tray holder 107 below the rotating disk assembly 101. It is to be noted that the main body 104 can also be a hollow frame or a wall surface, the present disclosure does not limit the shape and type of the main body 104. The tray holder 107 can hold a detachable tray (not shown) to catch contents spilled or dropped from the mixing bucket 108, wherein the volume of the tray is larger than or equal to the volume of the plurality of contents in one mixing bucket, such that the tray is able to contain the entire contents in the mixing bucket. The present disclosure does not limit the type, number, and volume of the tray holder 107 and the tray, for example, instead of using the tray, one can just use the tray holder 107 to catch the contents, or, one can dismiss the tray holder 107 completely and simply place the tray directly on the main body 104 under the rotating disk assembly 101. A sensor and alarm device (not shown) can further be installed on the tray holder 107 or the tray to detect whether there is a spill or leak, and the rotary bucket mixing device 1 can be set, as a safety control, to stop operating immediately and issue an alarm when there is a content spill, but the present disclosure is not limited thereby. Also, as shown in FIG. 1, the bucket support assembly includes at least one drainage hole 109 for draining the contents leaked from the mixing bucket, but the present disclosure is not limited thereby.

Figure 4:
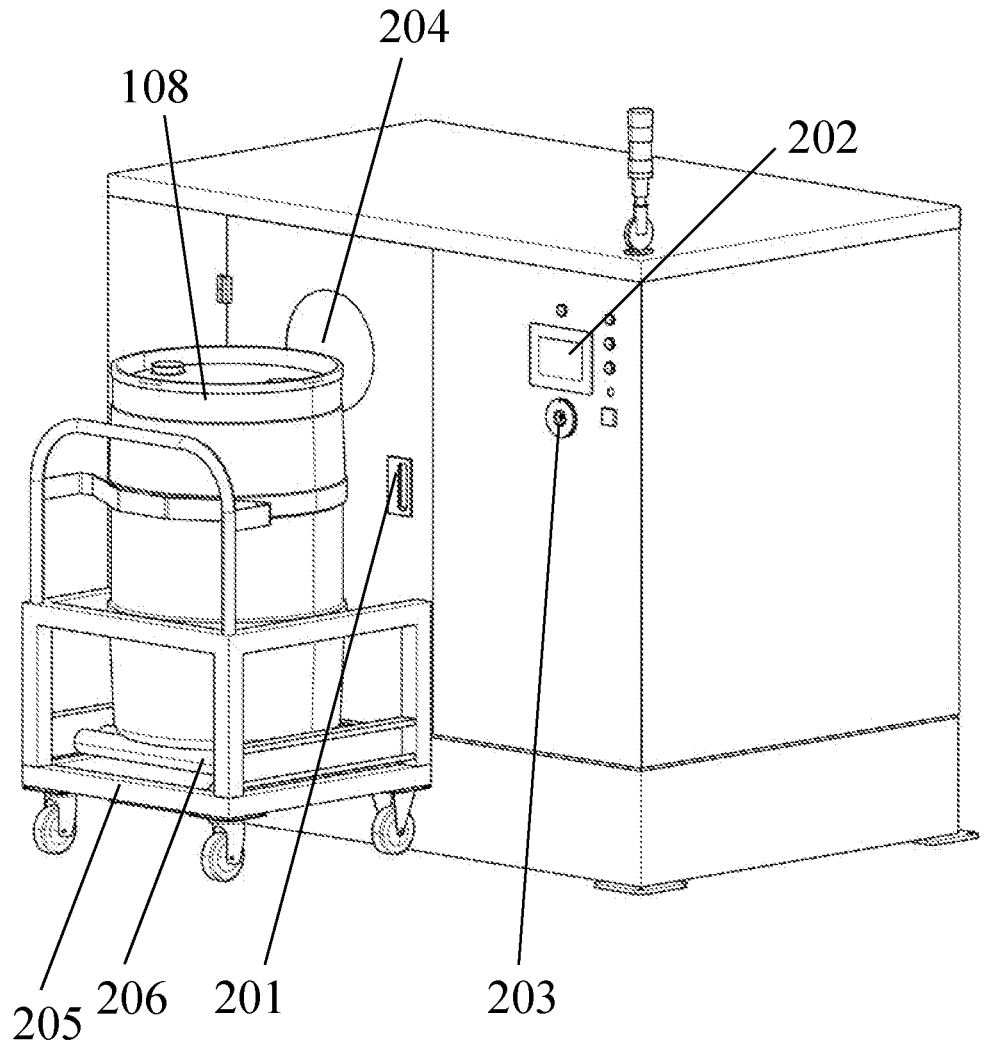
FIG. 4 is a schematic diagram illustrating a main body of a rotary bucket mixing device according to another embodiment of the present disclosure.

FIG. 4 is a schematic diagram of a main body according to another embodiment of the present disclosure. The main body 2 is a hexahedron that includes a cavity, a door knob 201 of a cavity door, a control panel 202, an emergency stop device 203, and a transparent window 204. The cavity is capable of accommodating the rotating disk assembly, the bucket support assembly, the power gear assembly and the idler assembly therein, such that the mixing process is carried out inside the cavity. In addition, the door knob 201 is locked before the mixing process is finished to ensure worker's safety during the mixing process. Or, the rotary bucket mixing device 1 can be set to immediately stop the mixing process when the cavity door is open to enhance the on-site safety. The main body 2 is also advantageous in noise isolation and exterior appearance.

Through the control panel 202, worker is able to adjust all of the parameters of the mixing process, like the mixing time and the mixing speed, and through the transparent window 204, observe the mixing process. When there is abnormality, the worker uses the emergency stop device 203 to stop the operation of the rotary bucket mixing device. Moreover, a pipeline-cleaning and spraying device is disposed inside the cavity for maintenance and cleaning after leakage and contamination. It is to be noted that the present disclosure does not limit the type and shape of the main body 2. A push cart 205 shown in FIG. 4 is used to transport the mixing bucket 108, and with help from the roller set 1015 of FIG. 3, to move the mixing bucket 108 into the cavity and mount the mixing bucket 108 in the hollow portion of the rotating disk assembly 101. With the help of the push cart 205, it is less effort and safer when transporting the mixing bucket, but the present disclosure is not limited thereby.

Herein described is the mixing process of the rotary bucket mixing device operated by the main body 2. First, as shown in FIG. 4, the push cart 205 carries the mixing bucket 108 and transports it to the front of the cavity door of the main body 2, wherein the cavity door is open. Then, the mixing bucket 108 is moved and loaded into the cavity with the assistance of rollers 206 and is mounted by the ring piece assembly and the clamp assembly. The cavity door is subsequently closed and the loading operation is completed. Next, the mixing parameters are set via the control panel 202 and the mixing process begins. During the mixing process, the power gear assembly receives the power to drive the rotating disk assembly to rotate, thereby causing the mixing bucket mounted on the rotating disk assembly to rotate, and the desired mixing result is achieved by controlling the rotational speed via the idler assembly. The mixing process can be observed at any time through the transparent window 204, and the mixing operation and quality can be monitored through the weighing module and the sensor and alarm device on the tray and/or the tray holder. When the plurality of contents leak from the mixing bucket during the mixing process, the weighing module or the sensor of the tray detects a weight difference and an alarm signal is sent via the alarm device to stop the mixing process as a safety control. Furthermore, when the mixing process is complete, as a safety measure, the cavity door of the main body 2 opens after the mixing bucket is in a complete stop and in the upright position. Last, when the mixing process is finished and the cavity door is open, the mixing bucket 108 is unloaded from the ring piece assembly and the clamp assembly, and moved back onto the push cart 205 with the assistance of the rollers 206. Hence, the mixing operation is completed.

In view of the above, the technical benefits of the rotary bucket mixing device as described by the embodiments of the present disclosure, in comparison to the conventional technology, is described below.

In conventional technology, some mixing devices only support the mixing bucket with two supporting points, which provides unsatisfactory support and may lead to improper mounting of the mixing bucket due to insufficient support to the mixing bucket, and thereby the worker's safety is a great concern. On the other hand, the rotary bucket mixing device of the present disclosure supports the mixing bucket through the rotating disk assembly, whereby the mixing bucket is mounted and held to the entire surface of the rotating disk assembly via the bucket mounting assembly of the bucket support assembly. Thus the supporting force is increased and the on-site safety during the mixing process is enhanced.

The above disclosure is only the preferred embodiment of the present invention, and not used for limiting the scope of the present invention. All equivalent variations and modifications on the basis of shapes, structures, features and spirits described in claims of the present invention should be included in the claims of the present invention.

What is claimed is:

1. A rotary bucket mixing device comprising:

a main body;

a rotating disk assembly, the rotating disk assembly being a circular body and comprising:

a plurality of first teeth formed on an outer ring periphery of the circular body; and a bucket support assembly formed at a hollow portion of the circular body, wherein the bucket support assembly provides support for a mixing bucket to be disposed in the hollow portion of the circular body;

a power gear assembly connected to the main body and comprising a power gear, wherein the power gear is in contact with and geared to a first portion of the first teeth and receives a power for driving the rotating disk assembly to rotate; and a first idler assembly connected to the main body and comprising a first idler, wherein the first idler is in contact with and geared to a second portion of the first teeth for controlling a rotational speed of the rotating disk assembly, wherein the bucket support assembly comprises:

a circular bearing support assembly with a hollow center for disposing the mixing bucket therein; and a bucket mounting assembly connected to the circular bearing support assembly for mounting the mixing bucket, wherein the bucket mounting assembly is pivotally connected to the rotating disk assembly.

2. The rotary bucket mixing device of claim 1, further comprising:

a power output device connected to the main body or the power gear assembly and pivotally connected to the power gear for generating the power to the power gear.

3. The rotary bucket mixing device of claim 2, wherein the power output device is a rotor motor device or a manpowered rotating disk device.

4. The rotary bucket mixing device of claim 1, further comprising:

a second idler assembly connected to the main body and comprising a second idler, wherein the second idler is in contact with and geared to a third portion of the first teeth for controlling the rotational speed of the rotating disk assembly.

5. The rotary bucket mixing device of claim 4, further comprising:

at least one weighing module disposed on at least one of the bucket support assembly, the first idler assembly, and the second idler assembly, for monitoring weight changes of a plurality of contents in the mixing bucket.

6. The rotary bucket mixing device of claim 1, wherein the bucket support assembly further comprises:

a ring piece assembly connected to the circular bearing support assembly and comprising an openable ring piece for encircling and mounting the mixing bucket; and a clamp assembly connected to the circular bearing support assembly and comprising a movable clamp for clamping the mixing bucket.

7. The rotary bucket mixing device of claim 1, wherein when the mixing bucket is disposed on the circular bearing support assembly, a tilt angle is formed between the mixing bucket and the rotating disk assembly, and the tilt angle is adjustable or controllable.

8. The rotary bucket mixing device of claim 1, wherein the bucket mounting assembly further comprises a roller set disposed at a bottom of the bucket mounting assembly for providing assistance in loading and unloading the mixing bucket onto and from the bucket mounting assembly.

9. The rotary bucket mixing device of claim 1, wherein the main body comprises a tray holder disposed below the rotating disk assembly, and the rotary bucket mixing device further comprises a tray detachably disposed in the tray holder for catching at least one content dropped from the mixing bucket.

10. A rotating disk assembly for use in a rotary bucket mixing device, the rotating disk assembly being a circular body and comprising:

a plurality of first teeth formed on an outer ring periphery of the circular body; and a bucket support assembly formed at a hollow portion of the circular body for providing support to a mixing bucket to be disposed in the hollow portion of the circular body;

wherein the bucket support assembly comprises:

a circular bearing support assembly connected to the rotating disk assembly and comprising a hollow center for disposing the mixing bucket therein; and a bucket mounting assembly connected to the circular bearing support assembly for mounting the mixing bucket, wherein the connection between the bucket mounting assembly and the circular bearing support assembly is pivotal.

11. The rotating disk assembly of claim 10, wherein the bucket mounting assembly further comprises:

a ring piece assembly connected to the circular bearing support assembly and comprising an openable ring piece for encircling and mounting the mixing bucket; and a clamp assembly connected to the circular bearing support assembly and comprising a movable clamp for clamping the mixing bucket.

12. The rotating disk assembly of claim 10, wherein when the mixing bucket is disposed on the circular bearing support assembly, a tilt angle is formed between the mixing bucket and the rotating disk assembly, and the tilt angle is adjustable or controllable.

13. The rotating disk assembly of claim 10, wherein the bucket mounting assembly further comprises:

a roller assembly disposed at a bottom of the bucket mounting assembly for providing assistance to the loading and unloading of the mixing bucket onto and from the bucket mounting assembly.

14. The rotating disk assembly of claim 10, further comprising at least one weighing module disposed on the bucket support assembly for monitoring weight changes of a plurality of contents in the mixing bucket.

15. A rotary bucket mixing device comprising:

a main body;

a rotating disk assembly, the rotating disk assembly being a circular body and comprising:

a plurality of first teeth formed on an outer ring periphery of the circular body; and a bucket support assembly formed at a hollow portion of the circular body, wherein the bucket support assembly provides support for a mixing bucket to be disposed in the hollow portion of the circular body;

a power gear assembly connected to the main body and comprising a power gear, wherein the power gear is in contact with and geared to a first portion of the first teeth and receives a power for driving the rotating disk assembly to rotate; and a first idler assembly connected to the main body and comprising a first idler, wherein the first idler is in contact with and geared to a second portion of the first teeth for controlling a rotational speed of the rotating disk assembly;

wherein the bucket support assembly comprises:

a circular bearing support assembly with a hollow center for disposing the mixing bucket therein;

a bucket mounting assembly connected to the circular bearing support assembly for mounting the mixing bucket;

a ring piece assembly connected to the circular bearing support assembly and comprising an openable ring piece for encircling and mounting the mixing bucket; and a clamp assembly connected to the circular bearing support assembly and comprising a movable clamp for clamping the mixing bucket.

16. A rotating disk assembly for use in a rotary bucket mixing device, the rotating disk assembly being a circular body and comprising:

a plurality of first teeth formed on an outer ring periphery of the circular body; and a bucket support assembly formed at a hollow portion of the circular body for providing support to a mixing bucket to be disposed in the hollow portion of the circular body;

wherein the bucket support assembly comprises:

a circular bearing support assembly connected to the rotating disk assembly and comprising a hollow center for disposing the mixing bucket therein; and a bucket mounting assembly connected to the circular bearing support assembly for mounting the mixing bucket;

wherein the bucket mounting assembly further comprises:

a ring piece assembly connected to the circular bearing support assembly and comprising an openable ring piece for encircling and mounting the mixing bucket; and a clamp assembly connected to the circular bearing support assembly and comprising a movable clamp for clamping the mixing bucket.

* * * * *